United States Patent [19]

Moeller et al.

[11] Patent Number: 4,652,880

[45] Date of Patent: Mar. 24, 1987

[54] ANTENNA FEED NETWORK

[75] Inventors: Alvin W. Moeller, Kingsville; Robert E. Willey, Joppa; Allen I. Sinsky, Reisterstown, all of Md.

[73] Assignee: Allied Corporation, Morristown, N.J.

[21] Appl. No.: 879,850

[22] Filed: Jun. 27, 1986

Related U.S. Application Data

[63] Continuation of Ser. No. 617,203, Jun. 4, 1984.

[51] Int. Cl.[4] ..... H01Q 3/26

[52] U.S. Cl. ..... 342/373; 342/372

[58] Field of Search ..... 342/369, 371, 373

[56] References Cited

U.S. PATENT DOCUMENTS

| | | | |
|---|---|---|---|
| 3,518,695 | 6/1970 | Schroeder | 343/368 |
| 3,803,625 | 4/1974 | Nemit | 343/854 |
| 4,041,501 | 8/1977 | Frazita et al. | 343/844 |
| 4,143,379 | 3/1979 | Wheeler | 343/854 |
| 4,321,605 | 3/1982 | Lopez | 343/844 |
| 4,414,550 | 11/1983 | Tresselt | 343/700 MS |

*Primary Examiner*—Theodore M. Blum
*Assistant Examiner*—D. Cain
*Attorney, Agent, or Firm*—Robert M. Trepp; Bruce L. Lamb

[57] ABSTRACT

An antenna feed network is described incorporating a plurality of power dividers and a plurality of power combiners to distribute at least two microwave signals over predetermined electrical path lengths to two overlapping subarrays of antenna elements forming an antenna aperture. The invention further provides a module incorporating a plurality of power dividers and power combiners utilizing Wilkenson strip-line power dividers and utilizing zero db branch arm hybrid couplers to provide wiring crossovers on the upper surface of a printed circuit board having a ground plane on its lower surface.

33 Claims, 9 Drawing Figures

190
191
192
193
-410-
-412-

190
191
192
193
-301-
-401-

-218-
-411-
-410-
-412-
-413-
V1
V2
V3
V4
V5
V6
V7
V8
Φ1
Φ2
Φ3
Φ4
Φ5
Φ6
Φ7

ANTENNA FEED NETWORK

This application is a continuation of application Ser. No. 617,203 filed June 4, 1984.

BACKGROUND OF THE INVENTION

1. Field of the Invention

This invention relates to microwave feed networks and more particularly to a microwave distribution network for dividing and combining a number of microwave signals for coupling to a plurality of antenna elements of a phased array antenna.

2. Description of the Prior Art

Phased array antennas typically have a plurality of radiating elements along a path. Each radiating element is fed with a microwave signal having a particular amplitude and phase. In the general case, a phase shifter is provided between a microwave signal and each element so that the phase of the microwave signal at each element may be controlled. In order to reduce the number of phase shifters required to drive a phased array antenna in limited scan applications, subarrays are fed with a microwave signal through a single phase shifter. The subarray which may comprise several antenna elements, such as two or greater, is fed with an antenna feed network where the microwave signal, after leaving the phase shifter, is divided and the signal power is prorated in a predetermined manner among the subarray antenna elements. The amount of power distributed to each antenna element is also known as the illumination function and by providing a predetermined illumination function such as a sin x/x pattern, a beam of a predetermined shape may be generated in the far field. The power distributed to the radiating elements of the subarray may also be adjusted to provide a Taylor, uniform, Chebycheff, or binomial function which is well known in the art. The subarrays of a phased array antenna may be spaced apart by a predetermined distance or may be overlapped with other subarrays. With overlapped subarrays, common antenna elements are used for each subarray and the antenna feed network must combine the microwave signals for each subarray together before feeding the common antenna element.

By overlapping subarrays and tailoring the subarray pattern to closely match the selected scan coverage region of the antenna, grating lobes and side lobes outside the selected scan coverage region may be suppressed.

In U.S. Pat. No. 4,321,605 which issued on Mar. 23, 1982 to Alfred R. Lopez, an array antenna is described. In FIG. 4, a plurality of 2N first transmission lines are shown for supplying wave energy to one of the element groups. Second transmission lines having a signal input end intersect a selected number of first transmission lines before being terminated at its other end. Directional couplers are provided for coupling the second transmission lines to the first transmission lines.

In U.S. Pat. No. 4,143,379 which issued on Mar. 6, 1979 to H. A. Wheeler, an antenna feed network is shown such as in FIGS. 3 and 7 for feeding a phased array antenna having overlapped subarrays. In FIG. 3, an 8 element subarray is shown being fed at input port 31*d* from one phase shifter wherein elements 2 and 7 in the subarray are not fed to provide a resulting sin x/x illumination pattern. The adjacent subarray, being fed at input port 31*c*, overlaps the subarray fed by input port 31*d* by 6 elements.

FIG. 7 shows a modular coupling network 94*d* with input port 31*d* which, when combined with a number of similar modules, provides a coupling network to several overlapped subarrays. In FIG. 7, branch line directional couplers, shown in more detail in FIG. 5, are used to divide the power further from power divider 36*d*. Zero db couplers are shown such as $82_a$ through $82_e$ for providing crossover networks in a single wiring plane. A more detailed description of the zero db couplers is found in column 5 and FIG. 6. As shown in FIGS. 3 and 7, the microwave signal from input port 31*d* is divided by power divider 36*d* and fed over two transmission lines to antenna element terminals 110*d* and 112*d*. Signals for other elements of the subarray are coupled from the two transmission lines feeding elements 110*d* and 112*d*.

In U.S. Pat. No. 4,041,501 which issued on Aug. 9, 1977 to R. F. Frazita et al., a phased array antenna system is described using coupling circuits to reduce the number of phase shifters required. In FIG. 6 phase shifter 13*a* provides a microwave signal to power divider 48 which divides the signal and provides it on transmission lines 50 and 52 to antenna elements 12*a* through 12*d*. In addition, couplers 58 and 60 couple microwave energy from transmission lines 50 and 52, respectively, onto transmission lines 56 and 54, respectively. Transmission lines 56 and 54 have attenuators 66 and 64 in the line to couple a predetermined amount of microwave energy to other antenna elements by way of couplers 58 and 60, respectively. As may be seen in FIG. 6, each phase shifter 13*a* through 13*f* provides a microwave signal to a respective module which in turn directly drives its antenna elements and at the same time couples power off to other antenna elements in other modules so as to provide overlapping subarrays with each subarray having a predetermined illumination function. Frazita et al. also shows in FIG. 2 and discusses in column 4, at lines 17–36, the spacing of the subarrays so that the grating lobe does not enter the subarray pattern when the array is scanned.

In U.S. Pat. No. 3,803,625 which issued on April 9, 1974 to J. T. Nemit, a network approach is described for reducing the number of phase shifters in a limited scan phased array. FIG. 5 of Nemit shows a three element subarray being fed by a microwave signal from phase shifter 29. The subarray and an adjacent subarray are overlapped by one antenna element. For example, element 20 is fed with microwave signals from phase shifters 28 and 29 and combined together by coupler 25.

While all of the prior art networks employ an overlapping subarray approach to reduce the number of phase shifters and provide suppression of grating lobes and side lobes outside the scan coverage region, each has certain characteristics which limits its usefulness or practicability. For example, in the network described by Lopez in U.S. Pat. No. 4,321,605, the antenna element on one end of the subarray is fed from the network input through a singular path of four couplers, while the antenna element on the opposite end of the subarray is fed through a singular path of eight couplers, and an antenna element in the middle of the subarray is fed through seven different paths and twelve couplers. The extreme asymmetry and multiple "sneak" paths make the design of this network quite complex and the physical realization of the desired element amplitudes and phases difficult.

In U.S. Pat. No. 4,321,605, Lopez points out that the usefulness of the Frazita network in U.S. Pat. No.

4,041,501 is limited by its frequency sensitivity, while the practicability of the Wheeler network in U.S. Pat. No. 4,143,379 is limited by the circuit complexity, resulting from the high number of network interconnections and crossovers.

Nemit in U.S. Pat. No. 3,803,625 describes only a 3 element subarray network in his patent. He suggests that a more ideal subarray pattern could be achieved by feeding a larger number of elements; however, as Frazita points out in U.S. Pat. No. 4,041,501, Nemit does not describe in U.S. Pat. No. 3,803,625 a practical technique for doing this.

Another important parameter that must be considered in determining the usefulness or practicability of a particular network is the network loss. All the prior art networks have an inherent loss over and above the normal ohmic conductor loss due to power absorbed in circuit attenuators and/or terminating loads which are dependent on the subarray illumination function and the particular set of hybrid coupling values selected. No reference is made in any of the prior disclosures to this loss or how the network may be designed to minimize it.

It is therefore desirable to provide a number of antenna feed networks for coupling microwave signals to overlapped subarrays of antenna elements in a phased array antenna to reduce the number of phase shifters required for limited scan application, while suppressing side lobes and grating lobes in the out-of-scan coverage region.

It is further desirable to provide a number of antenna feed networks for feeding overlapped subarrays of antenna elements with a subarray of 4 or more antenna elements with any desired subarray illumination function.

It is further desirable to provide a number of antenna feed networks for feeding overlapped subarrays of antenna elements with various degrees of phase shifter reduction, for example, 50 percent, 66 percent, 75 percent or more.

It is further desirable to provide antenna feed networks that have no loss over the normal ohmic conductor loss for the case where the subarray illumination function element weights are all in phase and a minimum loss for the case where the subarray illumination function element weights have any arbitrary phase.

It is further desirable that the networks have substantially equal path lengths between an input and any antenna element in the corresponding subarray to provide broadband performance.

It is further desirable that these networks have unique, singular propagation paths from an input to any element in the corresponding subarray to simplify network design and adjustment of the element amplitude and phase weight.

It is further desirable to provide a network having a distributed corporate arrangement of power dividers and combiners to minimize the number of crossovers and circuit complexity.

It is further desirable that the networks be modular in design and have two dimensional planar network topology for application to low-cost, practical circuit stripline and microstrip construction technology.

It is further desirable to provide an antenna feed network which utilizes Wilkenson dividers.

It is further desirable to provide an antenna feed network module which when coupled with other modules and to antenna elements will provide equal microwave signal length to each antenna element and will drive a plurality of overlapped subarrays.

SUMMARY OF THE INVENTION

An antenna feed network for distributing a plurality of microwave signals to a plurality of spaced apart antenna elements is described comprising a first plurality of dividers each having an input and at least two outputs such as a Wilkenson divider interconnected in series from each respective output to provide a plurality of first output terminals from a first input terminal, the first input terminal adapted for coupling to a microwave signal, a second plurality of power dividers each having an input and at least two outputs interconnected in series from each respective output to provide a plurality of second output terminals from a second input terminal, the second input terminal adapted for coupling to another microwave signal, a plurality of power combiners each having a first input coupled to one of said first output terminals, a second input coupled to selected ones of the plurality of microwave signals, each power combiner having an output terminal adapted for coupling to one of the antenna elements respectively, the first plurality of power dividers spaced apart to provide a predetermined electrical path length from the first input terminal to each of the first output terminals of the plurality of first power combiners, and the second plurality of power dividers spaced apart to provide a predetermined electrical path length from the second input terminal to each of the second output terminals of the second plurality of power combiners. The invention further provides an antenna feed network that may be readily subdivided into a plurality of identical modules.

DESCRIPTION OF THE PREFERRED EMBODIMENT

Figure 1:
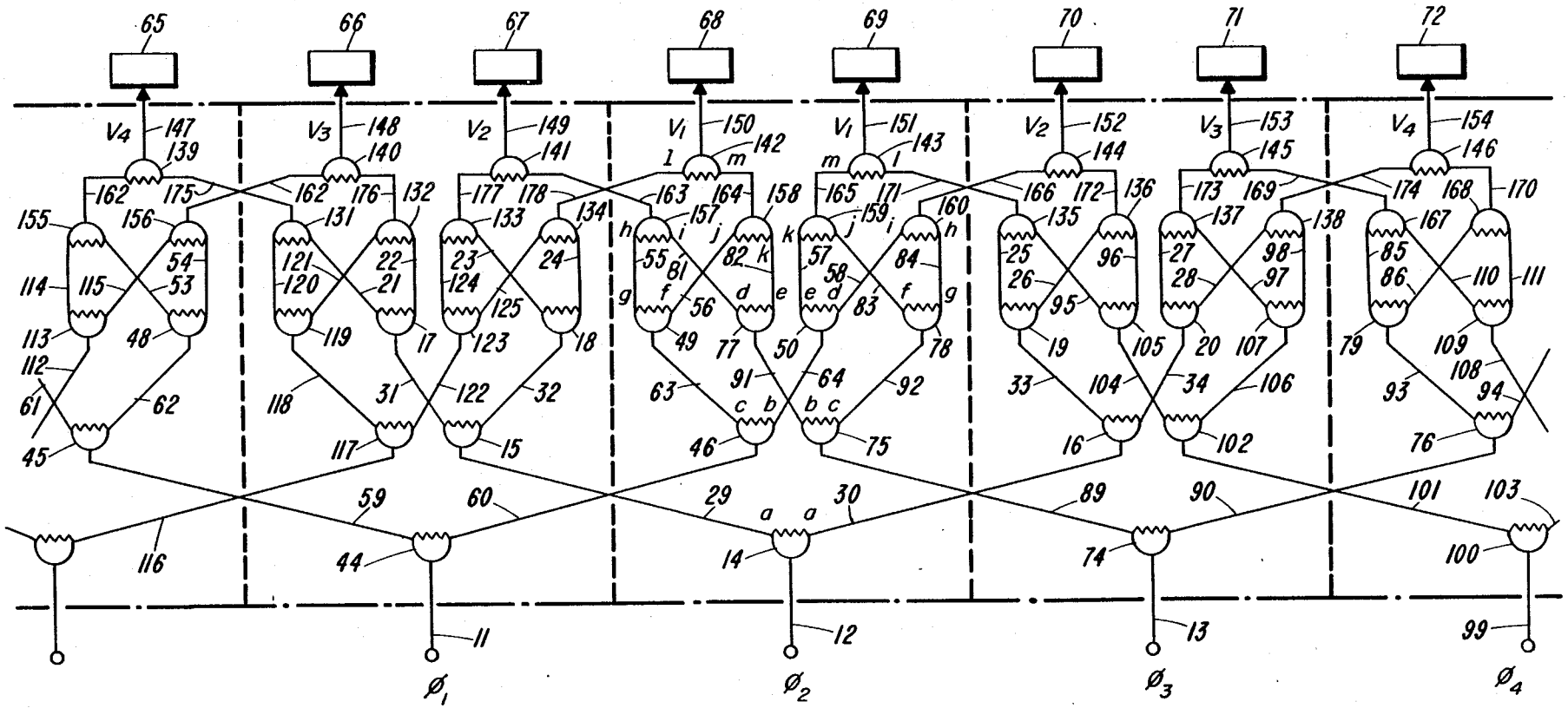
FIG. 1 is a schematic diagram of one embodiment of the invention.

Referring to the drawing and more particularly to FIG. 1, antenna feed network 10 is shown for distributing a plurality of microwave signals $\phi_1$, $\phi_2$, $\phi_3$ and $\phi_4$ on lines 11, 12, 13 and 99, respectively. Power dividers 14–20 each have an input and two outputs which may be for example a Wilkenson power divider which are interconnected in series from each respective output to provide a plurality of first output terminals 21–28 with respect to the input on line 12. As shown in FIG. 1, power divider 14 has a first output which is coupled over line 29 to an input of power divider 15. A second output is coupled over line 30 to an input of power divider 16. Power divider 15 has a first output coupled over line 31 to an input of power divider 17. A second output is coupled over line 32 to an input of power divider 18. Power divider 16 has a first output coupled over line 33 to an input of power divider 19. A second output of power divider 16 is coupled over line 34 to an input of power divider 20.

A second plurality of power dividers 44–46 and 48–50 each having an input and at least two outputs which may for example be a Wilkenson divider are interconnected in series from each respective output to provide a plurality of second output terminals 53–58 with respect to the input on line 11. As shown in FIG. 1, microwave signal $\phi_1$ is coupled over line 11 to an input of power divider 44. Power divider 44 has a first output coupled over line 59 to an input of power divider 45. A second output of power divider 44 is coupled over line 60 to an input of power divider 46. A first output of power divider 45 is coupled over line 61 to an input of a power divider not shown. The second output of power divider 45 is coupled over line 62 to an input of power divider 48. A first output of power divider 46 is coupled over line 63 to an input of power divider 49. A second output of power divider 46 is coupled over line 64 to an input of power divider 50.

A third plurality of power dividers 74–79 each having an input and at least two outputs are interconnected in series from each respective output to provide a plurality of third output terminals 81–86. As shown in FIG. 1, microwave signal $\phi_3$ is coupled over line 13 to an input of power divider 74. Power divider 74 has a first output coupled over line 89 to an input of power divider 75. A second output of power divider 74 is coupled over line 90 to an input of power divider 76. The first output of power divider 75 is coupled over line 91 to an input of power divider 77. The second output of power divider 75 is coupled over line 92 to an input of power divider 78. The first output of power divider 76 is coupled over line 93 to an input of power divider 79. The second output of power divider 76 is coupled over line 94 to a power divider not shown.

A fourth plurality of power dividers each having an input and at least two outputs are interconnected in series from each respective output to provide a plurality of fourth output terminals 95–98. A microwave signal $\phi_4$ is coupled over line 99 to an input of power divider 100. The first output of power divider 100 is coupled over line 101 to an input of power divider 102. The second output of power divider 100 is coupled over line 103 to a power divider not shown. The first output of power divider 102 is coupled over line 104 to an input of power divider 105. The second output of power divider 102 is coupled over line 106 to the input of power divider 107. Power divider 105 has output terminals 95 and 96 and power divider 107 has output terminals 97 and 98.

Also shown on the right side of FIG. 1 is line 108 coming from a power divider, not shown, which is coupled to the input of power divider 109. Power divider 109 has output terminals 110 and 111. Also shown on the left side of FIG. 1 is line 112 which is coupled to the output of a power divider, not shown, and is coupled to the input of power divider 113. Power divider 113 has output terminals 114 and 115. Also shown on the left hand side of FIG. 1 is line 116 from the output of a power divider which is coupled to the input of power divider 117. The output of power divider 117 is coupled over line 118 to the input of power divider 119. Power divider 119 has output terminals 120 and 121. A second output of power divider 117 is coupled over line 122 to the input of power divider 123. Power divider 123 has output terminals 124 and 125.

A plurality of power combiners 131–138 for combining microwave signals each have a first and second input. Each power combiner has one input coupled to terminals 21–28 respectively, which is coupled to microwave signal $\phi_2$. The output of power combiners 131 through 138 are coupled to an input of power combiners 139 through 146. The output of power combiners 139–146 are coupled over lines 147–154 to respective antenna elements 65–72. Lines 147–154 correspond to an 8 element subarray which receive signal $\phi_2$ by way of power combiners 131–138. Lines 147–152 form a partial subarray for microwave signal $\phi_1$. The complete subarray for microwave signal $\phi_1$ may include additional elements to the left of FIG. 1 so that the subarray has a total of 8 antenna elements. As shown in FIG. 1, microwave signal $\phi_1$ and its subarray overlap microwave signal $\phi_2$ and its subarray by 6 elements. Microwave signal $\phi_1$ is coupled through power combiners 155–160 over lines 161–166, respectively, to an input of power combiners 139–144, respectively.

Microwave signal $\phi_3$ is coupled to lines 149–154 which is a partial subarray with an overlap of 6 elements with the subarray associated with microwave signal $\phi_2$ comprising lines 147–154. Microwave signal $\phi_3$ is coupled through power combiners 157–160, 167 and 168 with the output coupled over lines 163–166, 169 and 170, respectively, to the input of power combiners 141–146.

Microwave signal $\phi_4$ is coupled to lines 151–154 to form a partial subarray with an overlap of 4 elements over the subarray containing microwave signal $\phi_2$. Microwave signal $\phi_4$ is coupled through power combiners 135–138 and over lines 171–174, respectively, to the input of power combiners 143–146.

As can be seen in FIG. 1 power dividers 14–20 are spaced apart to provide a predetermined electrical path length such as a substantially equal electrical path length from the input on line 12 or microwave signal $\phi_2$ to each output terminal of power dividers 17–20.

The second plurality of power dividers 44–50 are spaced apart to provide a predetermined electrical path length such as a substantially equal electrical path length from the input on line 11 or microwave signal $\phi_1$ to each output terminal of power dividers 48–50.

Equal line lengths from the subarray input on line 12 to the antenna elements 65–72 may be provided. Alternatively, the line lengths may be varied in a predetermined manner to provide a predetermined phase relationship at antenna elements 65–72 with respect to the input. Components to provide a fixed delay may be inserted into a line length such as to provide a 180° phase reversal for certain illumination functions. Instead of equal line lengths from the subarray input to the antenna elements, each unique line length from each subarray input to its elements may have a predetermined, uniform, progressive line length difference, enabling the phase weights at the elements to have a uniform, linear progression. Equal line lengths may be lengthened in increments, feeding antenna elements across an aperture to provide a phase difference of 40° or less across the antenna aperture. For example, this technique may be used to tilt a subarray pattern by 8°.

Figure 2:
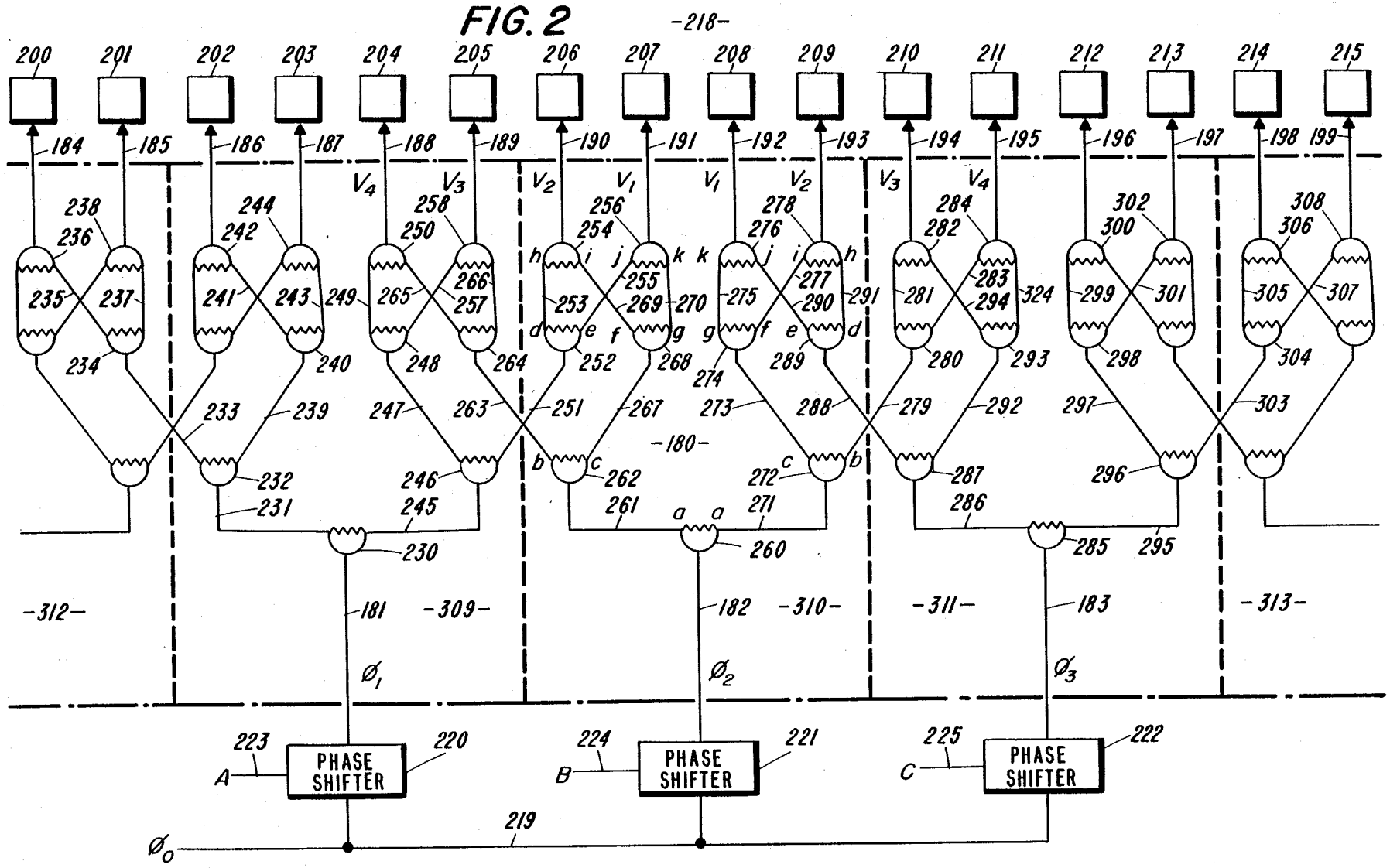
FIG. 2 is a schematic diagram of an alternate embodiment of the invention.

Referring to FIG. 2 a schematic diagram of an alternate antenna feed network 180 is shown. Antenna feed network 180 couples microwave signals on lines 181–183 to respective subarrays of antenna elements 200–215 of antenna 218. For example, microwave signal $\phi_1$ on line 181 is coupled over lines 184–191 to antenna elements 200–207 of antenna 218. Microwave signal $\phi_2$ on line 182 is coupled to antenna elements 204–211 over lines 188–195, respectively. Microwave signal $\phi_3$ on line 183 is coupled to antenna elements 208–215 over lines 192–199, respectively. As shown in FIG. 2, each microwave signal $\phi_1$–$\phi_3$ is coupled by antenna feed network 180 to a corresponding subarray of 8 antenna elements. Each subarray of 8 antenna elements overlaps 4 elements of the adjacent subarray.

Microwave signal $\phi_0$ is coupled over line 219 to an input of phase shifters 220–222. Phase shifters 220–222 respond to a control signal on lines 223–225, respectively, such as control signals A, B and C to provide a predetermined phase shift to the microwave signal $\phi_0$. The output of phase shifters 220–222 are microwave signals $\phi_1$–$\phi_3$, respectively.

Microwave signal $\phi_1$ is coupled over line 181 through power divider 230 over line 231 through power divider 232 over line 233 through power divider 234 over line 235 through power combiner 236 over line 184 to antenna element 200. Microwave signal $\phi_1$ is coupled from power divider 234 over line 237 through power combiner 238 over line 185 to antenna element 201. Microwave signal $\phi_1$ is coupled from power divider 232 over line 239 through power divider 240 over line 241 through power combiner 242 over line 186 to antenna element 202. Microwave signal $\phi_1$ is coupled from power divider 240 over line 243 through power combiner 244 to line 187 and antenna element 203.

Microwave signal $\phi_1$ is coupled from power divider 230 over line 245 through power divider 246 over line 247 through power divider 248 over line 249 through power combiner 250 over line 188 to antenna element 204. Microwave signal $\phi_1$ is coupled from power divider 248 over line 257 through power combiner 258 over line 189 to antenna element 205. Microwave signal $\phi_1$ is coupled from power divider 246 over line 251 through power divider 252 over line 253 through power combiner 254 over line 190 to antenna element 206. Microwave signal $\phi_1$ is coupled from power divider 252 over line 255 through power combiner 256 over line 191 to antenna element 207. The position of power dividers 230, 232, 234, 240, 246, 248 and 252 are positioned to provide substantially equal path length from line 181 to the output of power dividers 234, 240, 248 and 252. Power combiners 236,238, 242, 244, 258, 250, 254, and 256 are positioned to provide equal path length from the output of power dividers 234, 240, 248 and 252 to antenna elements 200–207. Power combiners 236, 238, 242, 244, 250, 258, 254 and 256 function to combine microwave signal $\phi_1$ with the microwave signal of an overlapping subarray.

Microwave signal $\phi_2$ is coupled over line 182 through power divider 260 over line 261 through power divider 262 over line 263 through power divider 264 over line 265 through power combiner 250 over line 188 to antenna element 204. Microwave signal $\phi_2$ is coupled from power divider 264 over line 266 through power combiner 258 over line 189 to antenna element 205. Microwave signal $\phi_2$ is coupled from power divider 262 over line 267 through power divider 268 over line 269 through power combiner 254 over line 190 to antenna element 206. Microwave signal $\phi_2$ is coupled from power divider 268 over line 270 through power combiner 256 over line 191 to antenna element 207. Microwave signal $\phi_2$ is coupled from power divider 260 over line 271 through power divider 272 over line 273 through power divider 274 over line 275 through power combiner 276 over line 192 to antenna element 208. Microwave signal $\phi_2$ is coupled from power divider 274 over line 277 through power combiner 278 over line 193 to antenna element 209. Microwave signal $\phi_2$ is coupled from power divider 272 over line 279 through power divider 280 over line 281 through power combiner 282 over line 194 to antenna element 210. Microwave signal $\phi_2$ is coupled from power divider 280 over line 283 through power combiner 284 over line 195 to antenna element 211.

Microwave signal $\phi_3$ is coupled over line 183 through power divider 285 over line 286 through power divider 287 over line 288 through power divider 289 over line 290 through power combiner 276 over line 192 to antenna element 208. Microwave signal $\phi_3$ is coupled from power divider 289 over line 291 through power combiner 278 over line 193 to antenna element 209. Microwave signal $\phi_3$ is coupled from power divider 287 over line 292 through power divider 293 over line 294 through power combiner 282 over line 194 to antenna element 210. Microwave signal $\phi_3$ is coupled from power divider 293 over line 324 through power combiner 284 over line 195 to antenna element 211. Microwave signal $\phi_3$ is coupled from power divider 285 over line 295 through power divider 296 over line 297 through power divider 298 over line 299 through power combiner 300 over line 196 to antenna element 212. Microwave signal $\phi_3$ is coupled from power divider 298 over line 301 through power combiner 302 over line 197 to antenna element 213. Microwave signal $\phi_3$ is coupled from power divider 296 over line 303 through power divider 304 over line 305 through power combiner 306 over line 198 to antenna element 214. Microwave signal $\phi_3$ is coupled from power divider 304 over line 307 through power combiner 308 over line 199 to antenna element 215.

Figure 3:
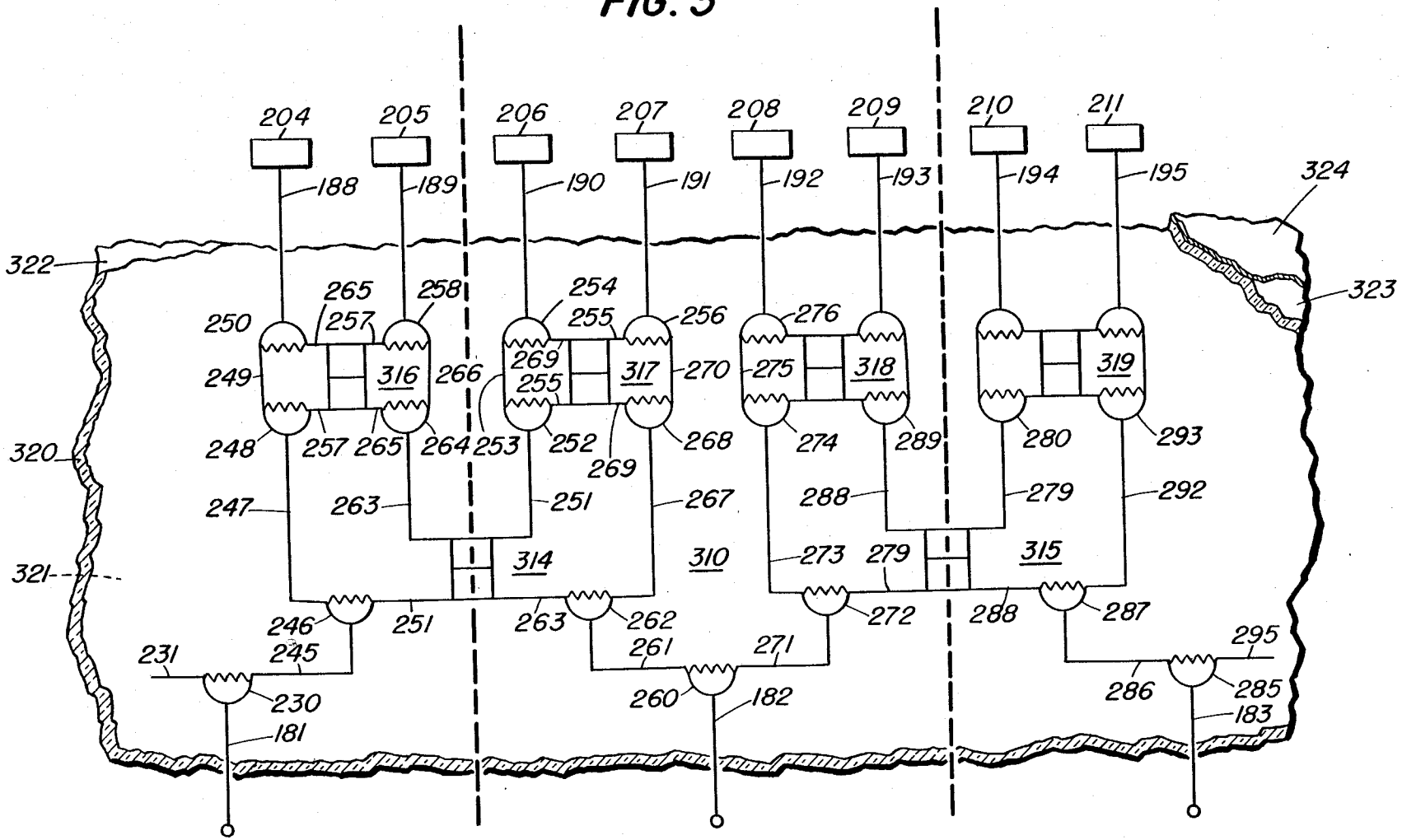
FIG. 3 is a diagram of one physical layout of the embodiment of FIG. 2.

Antenna feed network 180 may be subdivided into modules 309–311 which are shown in full and partial modules 312 and 313 which are shown in part. As shown in FIG. 3 modules 309–313 may be identical to provide an 8 element subarray for each microwave signal input with a 4 element overlap of each adjacent subarray which is provided when the modules are interconnected side by side. By using power dividers, such as Wilkenson power dividers which are spaced apart and interconnected in series, the path lengths from each microwave signal to each antenna element of its respective subarray may be substantially equal. By utilizing a distributed network of power dividers, such as a corporate feed network to each subarray, to provide predetermined equal path or lengths of each antenna element, the antenna feed network is less sensitive to the frequency of the microwave signal. The antenna feed network may therefore be operated over a broader frequency range.

FIG. 3 is a diagram of a wiring layout of a portion of the embodiment of FIG. 2. In FIG. 3 like references are used for functions corresponding to the apparatus of FIG. 2. As shown in FIG. 3 the circuit may be implemented on a two layer printed circuit board such that the conductors on one side of the printed circuit board form a microstrip with respect to the other side of the printed circuit board which may have a ground plane. As shown in FIG. 3 the layout is planar with crossovers 314–319 implemented with zero db couplers which are well known in the art.

Printed circuit board 320 has a lower surface 321 which may, for example, have a ground plane 322.

Alternatively, as shown in the upper right-hand corner of FIG. 3, the wiring layout may be implemented in strip transmission line form on a printed circuit board. The wiring layout would be in the middle with printed circuit board 320 and ground plane 322 below and dielectric layer 323 and ground plane 324 above. While Wilkenson power dividers and combiners are shown in schematic form in FIG. 3, other couplers may also be used in its place, such as a branch line coupler or forward wave direction coupler and a backward wave directional coupler.

Figure 4A:
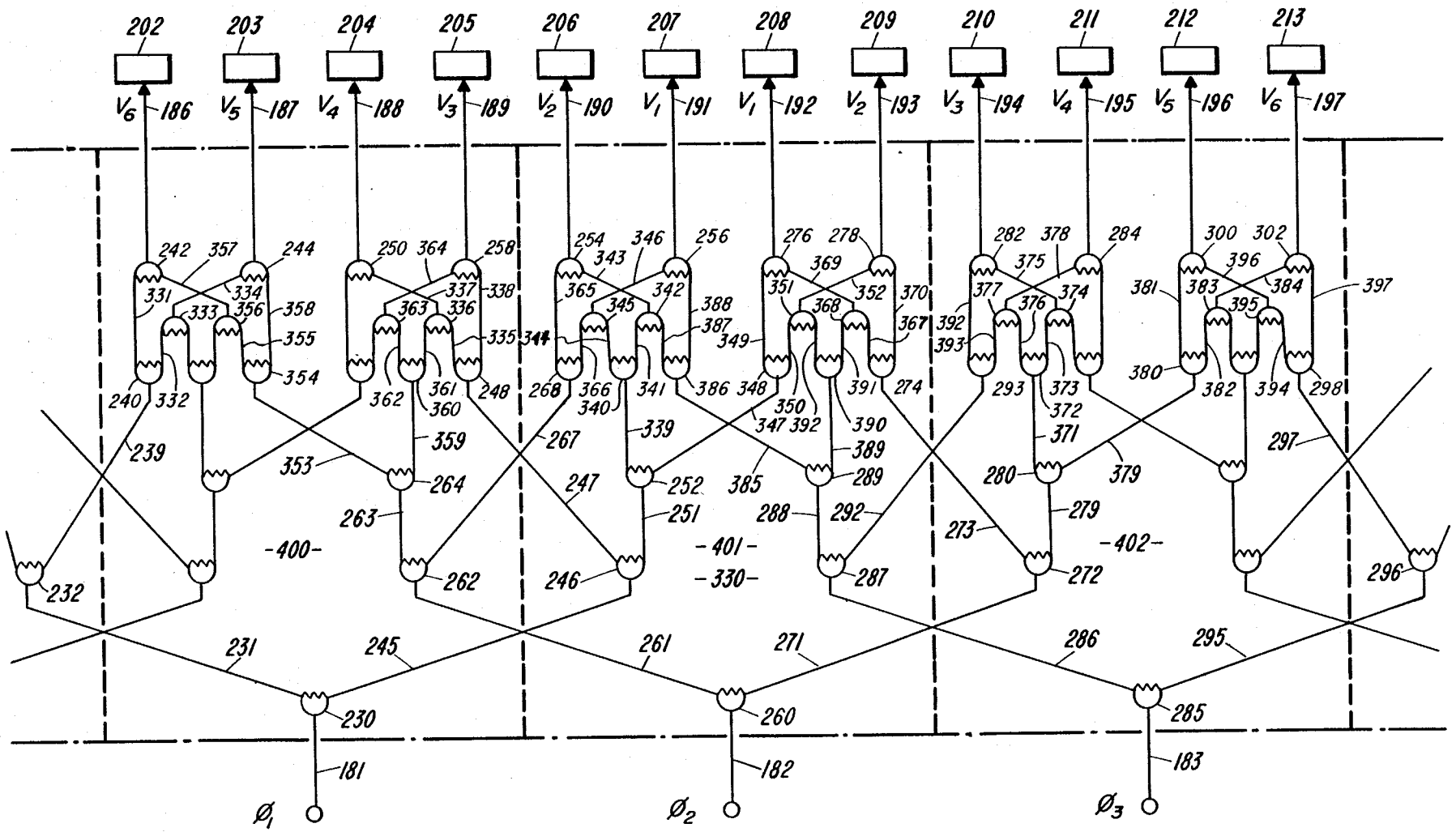
FIG. 4A is a schematic diagram of an alternate embodiment of the invention.
Figure 4B:
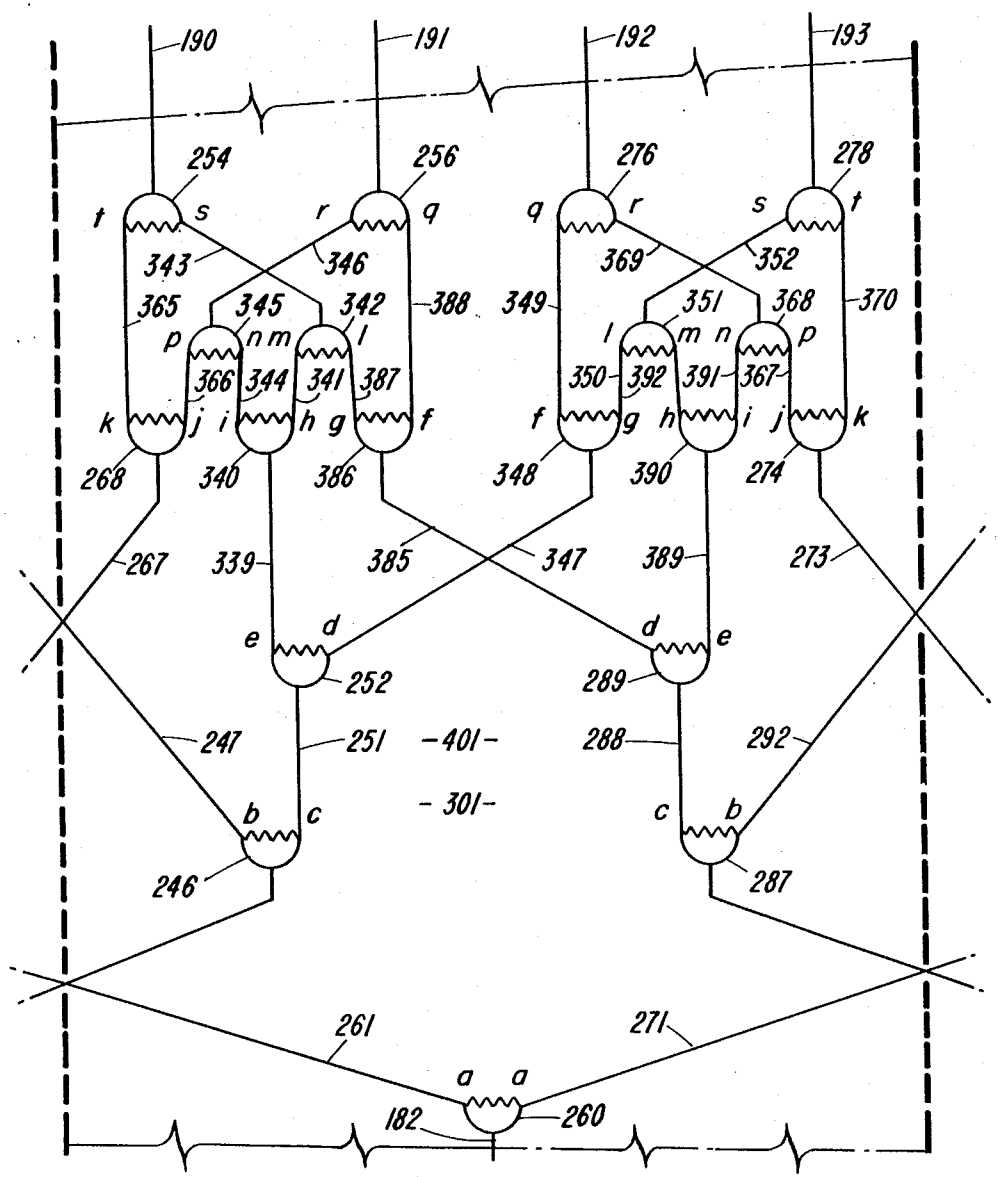
FIG. 4B is an enlarged view of a portion of FIG. 4A.

FIG. 4A is a schematic diagram of an alternate antenna feed network 330. FIG. 4B is an enlarged view of a portion of FIG. 4A. In FIGS. 4A and 4B like references are used for functions corresponding to the apparatus of FIG. 2. Each microwave signal $\phi_1$ through $\phi_3$ is distributed by antenna feed network 330 to a corresponding 12 element subarray. For example, microwave signal $\phi_2$ is distributed to antenna elements 202–213. Microwave signal $\phi_1$ is distributed to antenna elements 202–209 and 4 additional elements not shown, which normally would be shown on the left side of FIG. 4A. Microwave signal $\phi_3$ is distributed to antenna elements 206–213 and 4 additional antenna elements not shown, which normally would be shown on the right side of FIG. 4A. As shown in FIG. 4A, each subarray has 12 antenna elements which are overlapped by 8 antenna elements by the subarray on its left and by 8 antenna elements by the subarray on its right. Each antenna element has 3 microwave signals coupled thereto.

Microwave signal $\phi_1$ is coupled from power divider 240 over line 331 through power combiner 242 over line 186 to antenna element 202. Mircrowave signal $\phi_1$ is coupled from power divider 240 over line 332 through power divider 333 over line 334 through power combiner 244 over line 187 to antenna element 203. Microwave signal $\phi_1$ is coupled from power divider 248 over line 335 through power combiner 336 over line 337 through power combiner 250 over line 188 to antenna element 204. Microwave signal $\phi_1$ is coupled from power divider 248 over line 338 through power combiner 258 over line 189 to antenna element 205. Microwave signal $\phi_1$ is coupled from power divider 252 over line 339 through power divider 340 over line 341 through power combiner 342 over line 343 through power combiner 254 over line 190 to antenna element 206. Microwave signal $\phi_1$ is coupled from power divider 340 over line 344 through power combiner 345 over line 346 through power combiner 256 over line 191 to antenna element 207. Microwave signal $\phi_1$ is coupled from power divider 252 over line 347 through power divider 348 over line 349 through power combiner 276 over line 192 to antenna element 208. Microwave signal $\phi_1$ is coupled from power divider 348 over line 350 through power combiner 351 over line 352 through power combiner 278 over line 193 to antenna element 209.

Microwave signal $\phi_2$ is coupled from power divider 264 over line 353 through power divider 354 over line 355 through power combiner 356 over line 357 through power combiner 342 over line 186 to antenna element 202. Microwave signal $\phi_2$ is coupled from power divider 354 over line 358 through power combiner 244 over line 187 to antenna element 203. Microwave signal $\phi_2$ is coupled from power divider 264 over line 359 through power divider 360 over line 361 through power combiner 336 over line 337 through power combiner 250 over line 188 to antenna element 204. Microwave signal $\phi_2$ is coupled from power divider 360 over line 362 through power combiner 363 over line 364 through power combiner 258 over line 189 to antenna element 205. Microwave signal $\phi_2$ is coupled from power divider 268 over line 365 through power combiner 254 over line 190 to antenna element 206. Microwave signal $\phi_2$ is coupled from power divider 268 over line 366 through power combiner 345 over line 346 through power combiner 256 over line 191 to antenna element 207. Microwave signal $\phi_2$ is coupled from power divider 274 over line 367 through power combiner 368 over line 369 through power combiner 276 over line 192 to antenna element 208. Microwave signal $\phi_2$ is coupled from power divider 274 over line 370 through power combiner 278 over line 193 to antenna element 209. Microwave signal $\phi_2$ is coupled from power divider 280 over line 371 through power divider 372 over line 373 through power divider 374 over line 375 through power combiner 282 over line 194 to antenna element 210. Microwave signal $\phi_2$ is coupled from power divider 372 over line 376 through power combiner 377 over line 378 through power combiner 284 over line 195 to antenna element 211. Microwave signal $\phi_2$ is coupled from power divider 280 over line 379 through power divider 380 over line 381 through power combiner 300 over line 196 to antenna element 212. Microwave signal $\phi_2$ is coupled from power divider 380 over line 382 through power combiner 383 over line 384 through power combiner 302 over line 197 to antenna element 213.

Microwave signal $\phi_3$ is coupled from power divider 289 over line 385 through power divider 386 over line 387 through power combiner 342 over line 343 through power combiner 254 over line 190 to antenna element 206. Microwave signal $\phi_3$ is coupled from power divider 386 over line 388 through power combiner 256 over line 191 to antenna element 207. Microwave signal $\phi_3$ is coupled from power divider 289 over line 389 through power divider 390 over line 391 through power combiner 368 over line 369 through power combiner 276 over line 192 to antenna element 208. Microwave signal $\phi_3$ is coupled from power divider 390 over line 392 through power combiner 351 over line 352 through power combiner 278 over line 193 to antenna element 209. Microwave signal $\phi_3$ is coupled from power divider 293 over line 392 through power combiner 282 over line 194 to antenna element 210. Microwave signal $\phi_3$ is coupled from power divider 293 over line 393 through power combiner 377 over line 378 through power combiner 284 over line 195 to antenna element 211. Microwave signal $\phi_3$ is coupled from power divider 298 over line 394 through power combiner 395 over line 396 through power combiner 300 over line 196 to antenna element 212. Microwave signal $\phi_3$ is coupled from power divider 298 over line 397 through power combiner 302 over line 197 to antenna element 213.

As shown in FIG. 4A antenna feed network 330 may be subdivided into modules with a phase shifter supplying the microwave signal such as $\phi_1$ to module 400. Modules 400, 401, 402 are shown which, when placed side-by-side, will provide a feed network for subarrays of 12 antenna elements with the adjacent subarrays having an 8 element overlap. As shown in FIG. 4A the power dividers associated with each subarray are spaced apart to provide a substantially equal electrical path length from input 182 to each antenna element such as 202 through 213. As can be seen in FIG. 4A each module has 5 crossovers of microwave signals for the wiring layout.

Figure 5B:
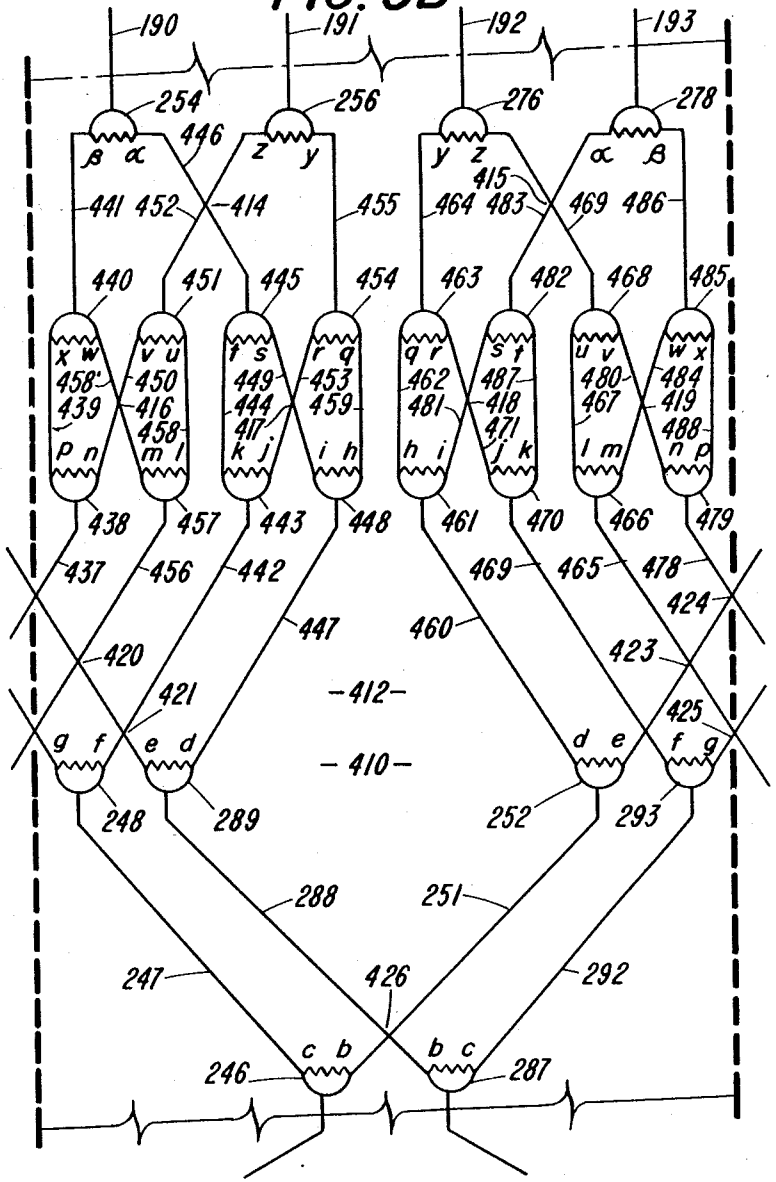
FIG. 5B is an enlarged view of a portion of FIG. 5A.
Figure 5A:
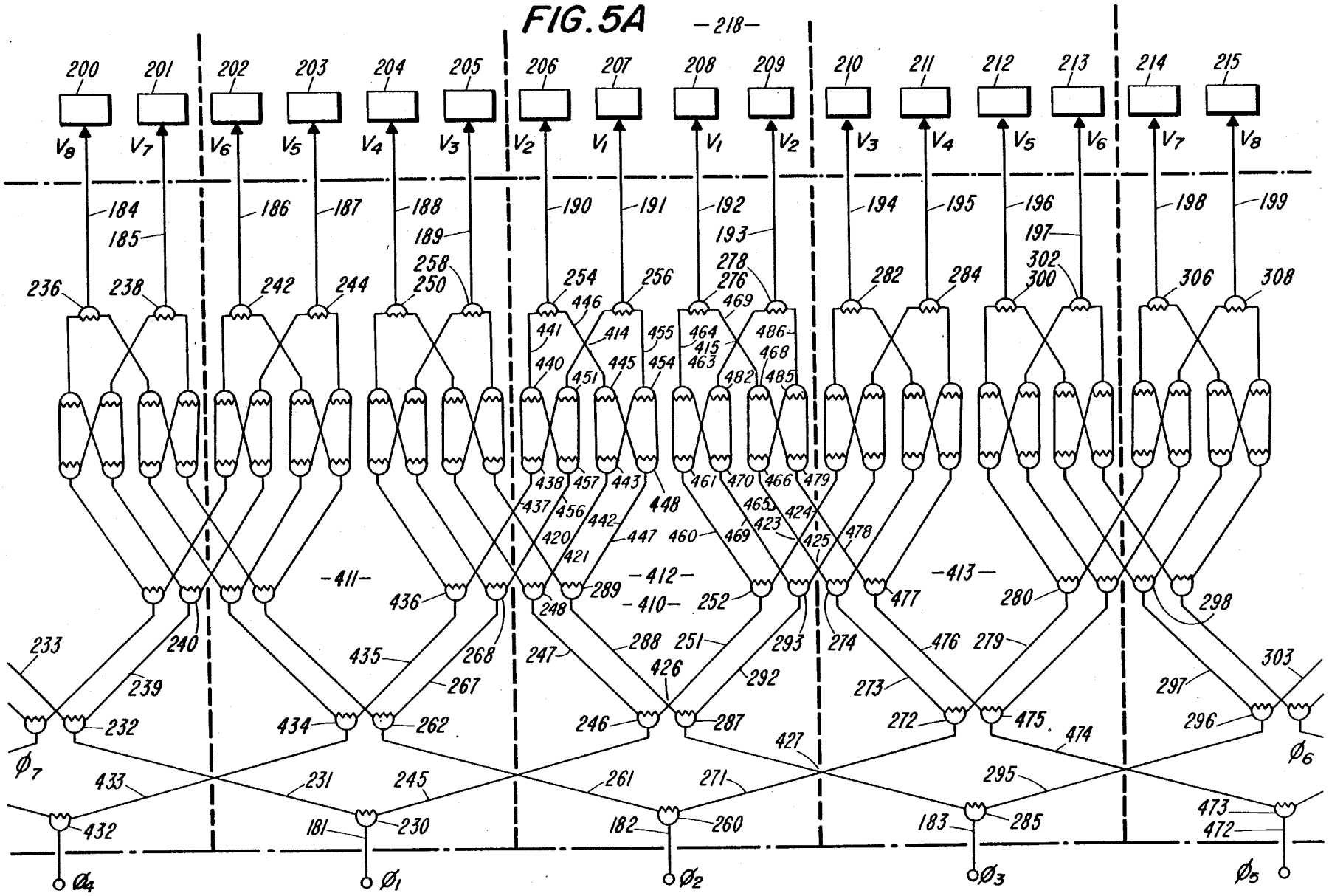
FIG. 5A is a schematic diagram of an alternate embodiment of the invention.

FIG. 5A is a schematic diagram of an alternate antenna feed network 410. FIG. 5B is an enlarged view of a portion of FIG. 5A. In FIGS. 5A and 5B like references are used for functions corresponding to the apparatus of FIG. 2. FIG. 5A shows an antenna feed network 410 for coupling a microwave signal such as $\phi_2$ on line 182 to 16 antenna elements 200–215. Antenna feed network 410 provides for a subarray overlap of 12 elements resulting in each antenna element being coupled to 4 microwave signals. Thus, each antenna element is common to 4 overlapping 16 element subarrays. Antenna feed network 410 may be subdivided into identical modules. When the modules are placed side by side and interconnected the resulting antenna feed network supplies a microwave signal to a subarray of 16 antenna elements with a 12 element overlap by an adjacent subarray. Modules 411, 412 and 413 shown in FIG. 5A each are identical with one another. Each module such as module 412 has 14 crossovers of microwave signal lines. These crossovers 414–427 may be implemented with a zero db coupler to provide a planar layout on a printed circuit board.

Each antenna element 204–207 receives 4 microwave signals $\phi_1$ through $\phi_4$. Each antenna element 200–203 receives 4 microwave signals $\phi_1$, $\phi_2$, $\phi_4$ and $\phi_7$. Each antenna element 208–211 receives 4 microwave signals, $\phi_1$, $\phi_2$, $\phi_3$ and $\phi_5$. Each antenna element 212–215 receives 4 microwave signals, $\phi_2$, $\phi_3$, $\phi_5$ and $\phi_6$.

As may be seen in FIG. 5A the power dividers with respect to a microwave signal are coupled in series and spaced apart through several modules to provide equal path length from the microwave signal input such as at line 182 to the output of each power divider feeding an antenna element. Likewise, the power combiners are coupled in series to receive 4 microwave input signals and are positioned to provide equal path length from the power combiner to the antenna element. By providing power dividers spaced apart through several modules, equal path length from a respective microwave input to its subarray of 16 antenna elements may be provided.

With respect to module 412, microwave input signal $\phi_2$ is coupled over line 182 and it along with three other microwave signals are provided at the output on lines 190–193 to respective antenna elements 206–209. Adjacent modules provide microwave signals to module 412 for coupling to antenna elements 206–209. In order to provide equal path length to each antenna element, microwave signal $\phi_2$ is coupled from module 412 to adjacent modules 411 and 413. In modules 411 and 413 microwave signal $\phi_2$ passes through two power dividers 262, and 268 with respect to module 411 and 272 and 274, with respect to module 413, before being coupled back to module 412 over lines 456 and 465.

Antenna element 206 receives 4 microwave signals. Microwave signal $\phi_4$ is coupled over line 431 through power divider 432 over line 433 through power divider 434 over line 435 through power divider 436 over line 437 through power divider 438 over line 439 through power combiner 440 over line 441 through power combiner 254 over line 190 to antenna element 206. Microwave signal $\phi_1$ is coupled from power divider 248 over line 442 through power divider 443 over line 444 through power combiner 445 over line 446 through power combiner 254 over line 190 to antenna element 206. Microwave signal $\phi_2$ is coupled from power divider 268 over line 456 through power divider 457 over line 458' through power combiner 440 over line 441 through power combiner 254 over line 190 to antenna element 206. Microwave signal $\phi_3$ is coupled from power divider 289 over line 447 through power divider 448 over line 449 through power combiner 445 over line 446 through power combiner 254 over line 190 to antenna element 206.

Antenna element 207 receives 4 microwave signals. Microwave signal $\phi_4$ is coupled from power divider 438 over line 450 through power combiner 451 over line 452 through power combiner 256 over line 191 to antenna element 207. Microwave signal $\phi_1$ is coupled from power divider 443 over line 453 through power combiner 454 over line 455 through power combiner 256 over line 191 to antenna element 207. Microwave signal $\phi_2$ is coupled from power divider 457 over line 458 through power combiner 451 over line 452 through power combiner 256 over line 191 to antenna element 207. Microwave signal $\phi_3$ is coupled from power divider 448 over line 459 through power combiner 454 over line 455 through power combiner 256 over line 191 to antenna element 207.

Antenna element 208 receives 4 microwave signals $\phi_1$–$\phi_3$ and $\phi_5$. Microwave $\phi_1$ is coupled from power divider 252 over line 460 through power divider 461 over line 462 through power combiner 463 over line 464 through power combiner 276 over line 192 to antenna element 208. Microwave signal $\phi_2$ is coupled from power divider 274 over line 465 through power divider 466 over line 467 through power combiner 468 over line 469 through power combiner 276 over line 192 to antenna element 208. Microwave signal $\phi_3$ is coupled from power divider 293 over line 469 through power divider 470 over line 471 through power combiner 463 over line 464 through power combiner 276 over line 192 to antenna element 208. Microwave signal $\phi_5$ is coupled over line 472 through power divider 473 over line 474 through power divider 475 over line 476 through power divider 477 over line 478 through power divider 479 over line 480 through power combiner 468 over line 469 through power combiner 276 over line 192 to antenna element 208.

Antenna element 209 receives 4 microwave signals $\phi_1$–$\phi_3$ and $\phi_5$. Microwave signal $\phi_1$ is coupled from power divider 461 over line 481 through power combiner 482 over line 483 through power combiner 278 over line 193 to antenna element 209. Microwave signal $\phi_2$ is coupled from power divider 466 over line 484 through power combiner 485 over line 486 through power combiner 278 over line 193 to antenna element 209. Microwave signal $\phi_3$ is coupled from power divider 470 over line 487 through power combiner 482 over line 483 through power combiner 278 over line 193 to antenna element 209. Microwave signal $\phi_5$ is coupled from power divider 479 over line 488 through power combiner 485 over line 486 through power combiner 278 over line 193 to antenna element 209.

As shown in FIG. 5A, module 412 receives microwave signals from itself and adjacent modules and couples 4 microwave signals to each antenna element 206–209. Likewise, modules 411 and 413 couple 4 microwave signals to each antenna element 202–205 and 210–213, respectively. By placing a number of modules adjacent one another and interconnecting them each module will provide a microwave signal input which may be coupled to a 16 element subarray via adjacent modules. Each adjacent subarray has a 12 element overlap.

Figure 6:
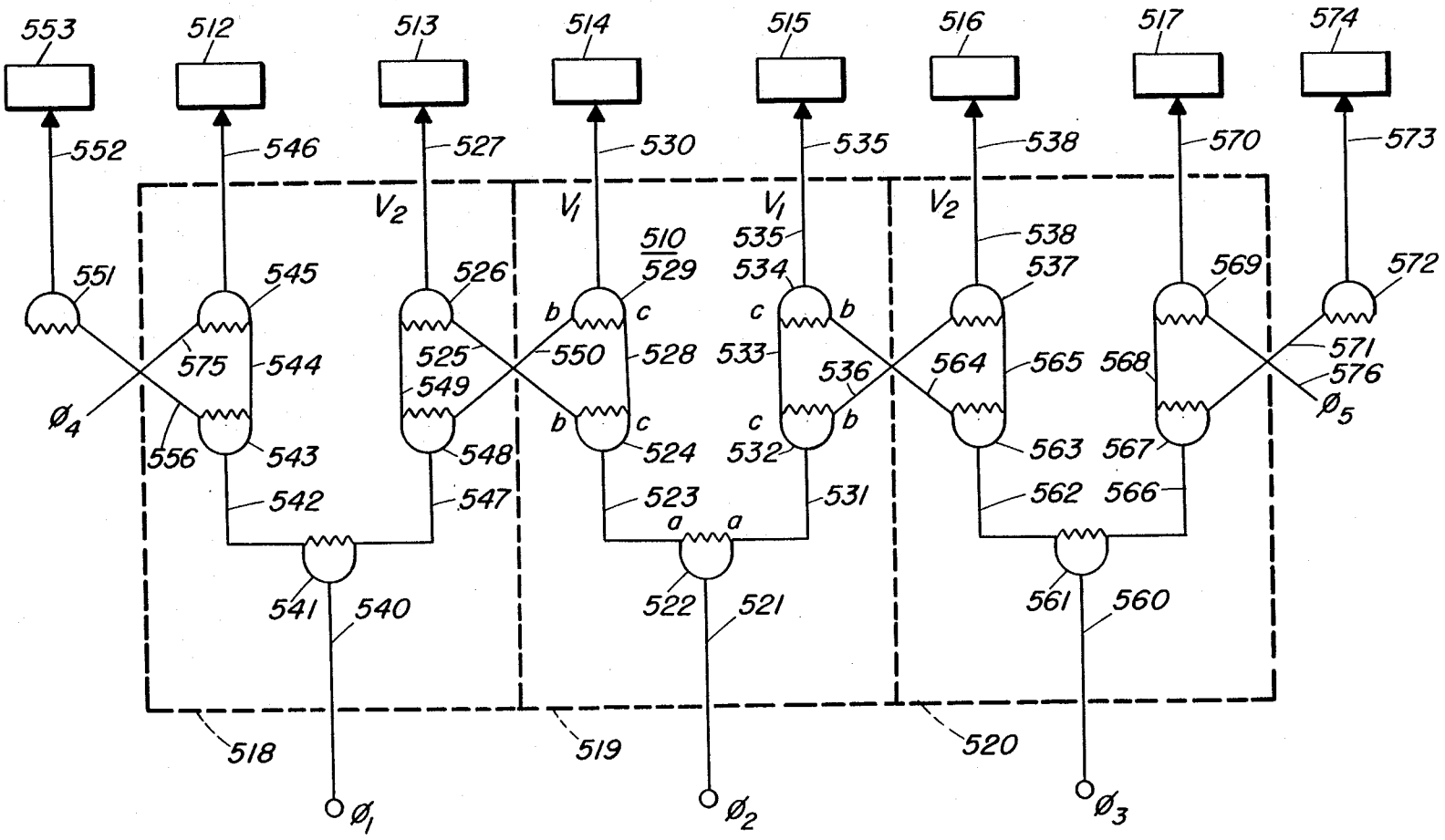
FIG. 6 is a schematic diagram of an alternate embodiment of the invention.

Referring to FIG. 6, an antenna feed network 510 is shown for coupling microwave signals $\phi_1$–$\phi_5$ to antenna elements 553, 512–517 and 574. Antenna feed network 510 may be subdivided into identical modules 518 through 520. Microwave $\phi_2$ is coupled over line 521 through power divider 522 over line 523 through power divider 524 over line 525 through power combiner 526 over line 527 to antenna element 513. Microwave signal $\phi_2$ is coupled from power divider 524 over line 528 through power combiner 529 over line 530 to antenna element 514. Microwave signal $\phi_2$ is coupled from power divider 521 over line 531 through power divider 532 over line 533 through power combiner 534 over line 535 to antenna element 515. Microwave signal $\phi_2$ is coupled from power divider 532 over line 536 through power combiner 537 over line 538 to antenna element 516. Thus, microwave signal $\phi_2$ is coupled to antenna elements 513–516 which form a four element subarray.

Microwave $\phi_1$ is coupled over line 540 through power divider 541 over line 542 through power divider 543 over line 544 through power combiner 545 over line 546 to antenna element 512. Microwave signal $\phi_1$ is coupled from power divider 541 over line 547 through power divider 548 over line 549 through power combiner 526 over line 527 to antenna element 513. Microwave signal $\phi_1$ is coupled from power divider 548 over line 550 through power combiner 529 over line 530 to antenna element 514. Microwave signal $\phi_1$ is coupled from power divider 543 over line 556 to power combiner 551 over line 552 to antenna element 553. Microwave signal $\phi_1$ is therefore coupled to four antenna elements 553 and 512–514.

Microwave signal $\phi_3$ is coupled over line 560 through power divider 561 over line 562 through power divider 563 over line 564 through power combiner 534 over line 535 to antenna element 515. Microwave signal $\phi_3$ is coupled from power divider 563 over line 565 through power combiner 537 over line 538 to antenna element 516. Microwave signal $\phi_3$ is coupled from power divider 561 over line 566 through power divider 567 over line 568 through power combiner 569 over line 570 to antenna element 517. Microwave signal $\phi_3$ is coupled from power divider 567 over line 571 through power combiner 572 over line 573 to antenna element 574. Thus microwave signal $\phi_3$ is coupled to four antenna elements 515–517 and 574. Microwave signal $\phi_4$ is coupled over line 575 through power combiner 545 over line 546 through antenna element 517. Microwave signal $\phi_5$ is coupled over line 576 through power combiner 569 over line 570 to antenna element 517.

As shown in FIG. 6 microwave signals $\phi_1$–$\phi_4$ each feed four antenna elements to form respective subarrays wherein each subarray is overlapped by two elements with the adjacent subarray.

Figure 7:
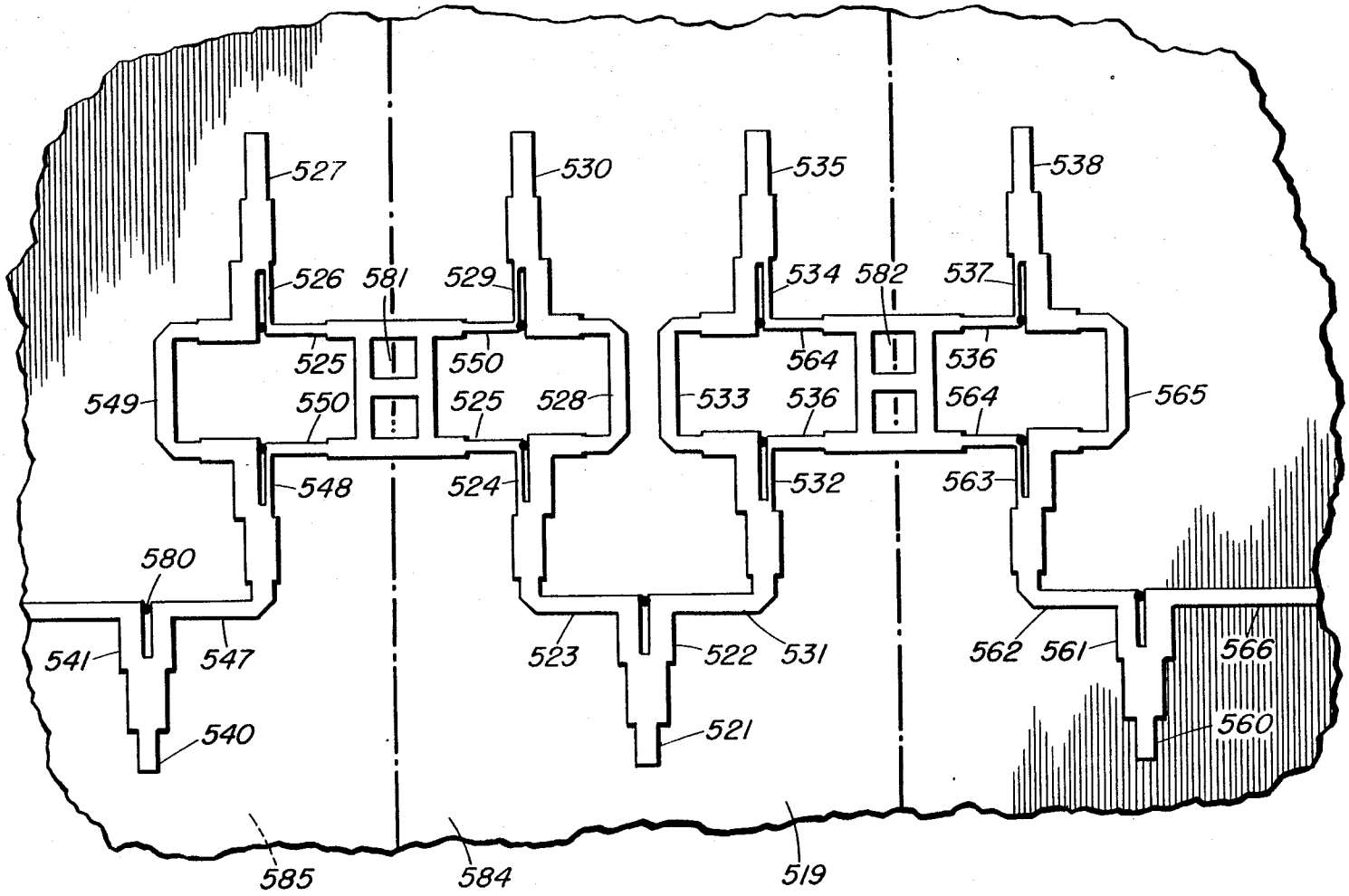
FIG. 7 is a plan view of one physical layout on a printed circuit board of a portion of the embodiment of FIG. 6.

Referring to FIG. 7, a plan view is shown of a portion of antenna feed network 510. In FIG. 7 like references are used for functions corresponding to the apparatus of FIG. 6. As shown in FIG. 7 the power dividers and power combiners are implemented with Wilkenson-type power dividers and combiners. Each Wilkenson power divider or combiner has a resistor shown, for example, as resistor 580 for power divider 541. Crossovers 581 and 582 are provided by zero db branch line couplers, which are well known in the art. The electrical path length from each input to an output, such as from line 521 to lines 527, 530, 535 and 538 are substantially equal. Additional length has been added to lines 528 and 533 to compensate for the length of lines 525 and 536 through zero db couplers 581 and 582, respectively.

The desired illumination function for a plurality of subarrays may be expressed by the voltage at each antenna element of one subarray arising from the microwave signal at the subarray input. For example, in FIG. 1, the subarray illumination function on lines 147–154 may be expressed as a voltage $V_4$–$V_1$ and $V_1$–$V_4$, respectively, arising from the microwave signal $\phi_2$ on line 12.

For a subarray of antenna feed network 10 shown in FIG. 1, equations 1–4 may be written for $E_1$–$E_4$ where $V_1$–$V_4$ are the microwave signal voltages at the antenna elements.

$$E_1=V_1(V_1+V_2+V_3+V_4) \quad (1)$$

$$E_2=V_2(V_1+V_2+V_3+V_4) \quad (2)$$

$$E_3=V_3(V_1+V_2+V_3+V_4) \quad (3)$$

$$E_4=V_4(V_1+V_2+V_3+V_4) \quad (4)$$

The terms $D_1$ and $D_2$ are defined by equations 5a and 5b, where $E_1$–$E_4$ are expressed in equations 1–4.

$$D_1=E_1+E_2+E_3+E_4 \quad (5a)$$

$$D_2=V_1+V_2+V_3+V_4 \quad (5b)$$

The coupling coefficients a–m for inputs and outputs of power combiners and power dividers shown in FIG. 1 are provided by equations 6–18, where $E_1$–$E_4$ and D are defined by equations 1–5.

$$a=(\tfrac{1}{2})^{\frac{1}{2}} \quad (6)$$

$$b=((E_3+E_4)/D)^{\frac{1}{2}} \quad (7)$$

$$c=((E_1+E_2)/D)^{\frac{1}{2}} \quad (8)$$

$$d=(E_4/(E_3+E_4))^{\frac{1}{2}} \quad (9)$$

$$e=(E_3/(E_3+E_4))^{\frac{1}{2}} \quad (10)$$

$$f=(E_2/(E_1+E_2))^{\frac{1}{2}} \quad (11)$$

$$g=(E_1/(E_1+E_2))^{178} \quad (12)$$

$$h=(V_1/(V_1+V_4))^{\frac{1}{2}} \quad (13)$$

$$i=(V_4/(V_1+V_4))^{\frac{1}{2}} \quad (14)$$

$$j=(V_2/(V_2+V_3))^{\frac{1}{2}} \quad (15)$$

$$k=(V_3/(V_2+V_3))^{\frac{1}{2}} \quad (16)$$

$$l=((V_1+V_4)/D_2)^{\frac{1}{2}} \quad (17)$$

$$m=((V_2+V_3)/D_2)^{\frac{1}{2}} \quad (18)$$

In FIG. 2, the subarray illumination function on lines 188–195 may be expressed as a voltage $V_4$–$V_1$ and $V_1$–$V_4$, respectively, arising from the microwave signal $\phi_2$ on line 182.

For a subarray of antenna feed network 180, equations 19–22 may be written for terms $E_1$–$E_4$, where $V_1$–$V_4$ are the microwave signal voltages at the antenna elements due to the subarray input voltage.

$$E_1=V_1(V_1+V_4) \quad (19)$$

$$E_2=V_2(V_2+V_3) \quad (20)$$

$$E_3=V_3(V_2+V_3) \quad (21)$$

$$E_4=V_4(V_1+V_4) \quad (22)$$

The term D is defined by equation 23, where $E_1$–$E_4$ are expressed in equations 19–22.

$$D=E_1+E_2+E_3+E_4 \quad (23)$$

The coupling coefficients a–k for inputs and outputs of power combiners and power dividers shown in FIG. 2 are provided by equations 24–34, where $E_1$–$E_4$ and D are defined by equations 19–23.

$$a=(\tfrac{1}{2})^{\frac{1}{2}} \quad (24)$$

$$b=((E_1+E_2)/D)^{\frac{1}{2}} \quad (25)$$

$$c=((E_3+E_4)/D)^{\frac{1}{2}} \quad (26)$$

$$d=(E_1/(E_1+E_2))^{\frac{1}{2}} \quad (27)$$

$$e=(E_2/(E_1+E_2))^{\frac{1}{2}} \quad (28)$$

$$f=(E_4/(E_3+E_4))^{\frac{1}{2}} \quad (29)$$

$$g=(E_3/(E_3+E_4))^{\frac{1}{2}} \quad (30)$$

$$h=(V_1/(V_1+V_4))^{\frac{1}{2}} \quad (31)$$

$$i=(V_4/(V_1+V_4))^{\frac{1}{2}} \quad (32)$$

$$j=(V_2/(V_2+V_3))^{\frac{1}{2}} \quad (33)$$

$$k=(V_3/(V_2+V_3))^{\frac{1}{2}} \quad (34)$$

In FIG. 4A, the subarray illumination function on lines 186–197 may be expressed as a voltage $V_6$–$V_1$, and $V_1$–$V_6$, respectively, arising from the microwave signal $\phi_2$ on line 182.

For a subarray of antenna feed network 330, equations 35–40 may be written for terms $E_1$–$E_6$, where $V_1$–$V_6$ are the microwave signal voltages at the antenna elements, lines 186–197, due to the subarray input voltage.

$$E_1=V_1(V_1+V_4+V_5) \quad (35)$$

$$E_2=V_2(V_2+V_3+V_6) \quad (36)$$

$$E_3=V_3(V_2+V_3+V_6) \quad (37)$$

$$E_4=V_4(V_1+V_4+V_5) \quad (38)$$

$$E_5=V_5(V_1+V_4+V_5) \quad (39)$$

$$E_6=V_6(V_2+V_3+V_6) \quad (40)$$

The term D is defined by equation 41, where $E_1$–$E_6$ are expressed in equations 35–40.

$$D=E_1+E_2+E_3+E_4+E_5+E_6 \quad (41)$$

The coupling coefficients a–t for inputs and outputs of power combiners and power dividers shown in FIGS. 4A and 4B are provided by equations 42–60, where $E_1$–$E_6$ and D are expressed in equations 35–41.

$$a=(\tfrac{1}{2})^{\frac{1}{2}} \quad (42)$$

$$b=((E_1+E_2)/D)^{\frac{1}{2}} \quad (43)$$

$$c=((E_3+E_4+E_5+E_6)/D)^{\frac{1}{2}} \quad (44)$$

$$d=((E_5+E_6)/(E_3+E_4+E_5+E_6))^{\frac{1}{2}} \quad (45)$$

$$e=((E_3+E_4)/(E_3+E_4+E_5+E_6))^{\frac{1}{2}} \quad (46)$$

$$f=(E_5/(E_5+E_6))^{\frac{1}{2}} \quad (47)$$

$$g=(E_6/(E_5+E_6))^{\frac{1}{2}} \quad (48)$$

$$h=(E_3/(E_3+E_4))^{\frac{1}{2}} \quad (49)$$

$$i=(E_4/(E_3+E_4))^{\frac{1}{2}} \quad (50)$$

$$j=(E_1/(E_1+E_2))^{\frac{1}{2}} \quad (51)$$

$$k=(E_2/(E_1+E_2))^{\frac{1}{2}} \quad (52)$$

$$l=(V_6/V_3+V_6))^{\frac{1}{2}} \quad (53)$$

$$m=(V_3/(V_3+V_6))^{\frac{1}{2}} \quad (54)$$

$$n=(V_4/(V_1+V_4))^{\frac{1}{2}} \quad (55)$$

$$p=(V_1/(V_1+V_4))^{\frac{1}{2}} \quad (56)$$

$$q=(V_5/(V_1+V_4+V_5))^{\frac{1}{2}} \quad (57)$$

$$r=((V_1+V_4)/(V_1+V_4+V_5))^{\frac{1}{2}} \quad (58)$$

$$s=((V_3+V_6)/(V_2+V_3+V_3+V_6))^{\frac{1}{2}} \quad (59)$$

$$t=(V_2/(V_2+V_3+V_6))^{\frac{1}{2}} \quad (60)$$

In FIG. 5A, the subarray illumination function on lines 84–199 may be expressed as a voltage $V_8$–$V_1$ and $V_1$–$V_8$, respectively, arising from the microwave signal $\phi_2$ on line 182. For a subarray of antenna feed network 410, equations 61–68 may be written for terms $E_1$–$E_8$, where $V_1$–$V_8$ are the microwave signal voltages at the antenna elements, lines 184–199, due to the subarray input voltage.

$$E_1=V_1(V_1+V_4+V_5+V_8) \quad (61)$$

$$E_2=V_2(V_2+V_3+V_6+V_7) \quad (62)$$

$$E_3=V_3(V_2+V_3+V_6+V_7) \quad (63)$$

$$E_4=V_4(V_1+V_4+V_5+V_8) \quad (64)$$

$$E_5=V_5(V_1+V_4+V_5+V_8) \quad (65)$$

$$E_6=V_6(V_2+V_3+V_6+V_7) \quad (66)$$

$$E_7=V_7(V_2+V_3+V_6+V_7) \quad (67)$$

$$E_8=V_8(V_1+V_4+V_5+V_8) \quad (68)$$

The terms $D_1$–$D_4$ are defined by equations 69–72, where $E_1$–$E_8$ are expressed in equations 61–68 and $V_1$–$V_8$ are shown in FIG. 5A.

$$D_1=E_1+E_2+E_3+E_4 \quad (69)$$

$$D_2=E_5+E_6+E_7+E_8 \quad (70)$$

$$D_3=V_1+V_4+V_5+V_8 \quad (71)$$

$$D_4=V_2+V_3+V_6+V_7 \quad (72)$$

The coupling coefficients a–z, $\alpha$ and $\beta$ for inputs and outputs of power combiners and power dividers shown in FIGS. 5A and 5B are provided by equations 73–99, where $E_1$–$E_8$ and $D_1$–$D_4$ are expressed in equations 61–72.

$$a=(\tfrac{1}{2})^{\frac{1}{2}} \quad (73)$$

$$b=(D_2/(D_1+D_2))^{\frac{1}{2}} \quad (74)$$

$$c=(D_1/(D_1+D_2))^{\frac{1}{2}} \quad (75)$$

$$d=((E_5+E_6)/D_2)^{\frac{1}{2}} \quad (76)$$

$$e=((E_7+E_8)/D_2)^{\frac{1}{2}} \quad (77)$$

$$f=((E_3+E_4)/D_1)^{\frac{1}{2}} \quad (78)$$

$$g=((E_1+E_2)/D_1)^{\frac{1}{2}} \quad (79)$$

$$h=(E_5/(E_5+E_6))^{\frac{1}{2}} \quad (80)$$

$$i=(E_6/(E_5+E_6))^{\frac{1}{2}} \quad (81)$$

$$j=(E_4/(E_3+E_4))^{\frac{1}{2}} \quad (82)$$

$$k=(E_3/(E_3+E_4))^{\frac{1}{2}} \quad (83)$$

$$l=(E_1/(E_1+E_2))^{\frac{1}{2}} \quad (84)$$

$$m=(E_2/(E_1+E_2))^{\frac{1}{2}} \quad (85)$$

$$n=(E_8/(E_7+E_8))^{\frac{1}{2}} \quad (86)$$

$$p=(E_7/(E_7+E_8))^{\frac{1}{2}} \quad (87)$$

$$q=(V_5/(V_4+V_5))^{\frac{1}{2}} \quad (88)$$

$$r=(V_4/(V_4+V_5))^{\frac{1}{2}} \quad (89)$$

$$s=(V_1/(V_1+V_8))^{\frac{1}{2}} \quad (90)$$

$$t=(V_8/(V_1+V_8))^{\frac{1}{2}} \quad (91)$$

$$u=(V_6/(V_3+V_6))^{\frac{1}{2}} \quad (92)$$

$$v=(V_3/(V_3+V_6))^{\frac{1}{2}} \quad (93)$$

$$w=(V_2/(V_2+V_7))^{\frac{1}{2}} \quad (94)$$

$$x=(V_7/(V_2+V_7))^{\frac{1}{2}} \quad (95)$$

$$y=((V_4+V_5)/D_3)^{\frac{1}{2}} \quad (96)$$

$$z=((V_1+V_8)/D_3)^{\frac{1}{2}} \quad (97)$$

$$\alpha=((V_3+V_6)/D_4)^{\frac{1}{2}} \quad (98)$$

$$\beta=((V_2+V_7)/D_4)^{\frac{1}{2}} \quad (99)$$

In FIG. 6, the subarray illumination function on lines 527, 530, 535 and 538 may be expressed as a voltage $V_2$, $V_1$, $V_1$ and $V_2$, respectively, arising from the microwave signal $\phi_2$ on line 521.

The coupling coefficients a–c for inputs and outputs of power combiners and power dividers shown in FIG. 6 are provided by equations 100–102.

$$a=(\tfrac{1}{2})^{\frac{1}{2}} \quad (100)$$

$$b=(V_2/(V_1+V_2))^{\frac{1}{2}} \quad (101)$$

$$c=(V_1/(V_1+V_2)^{\frac{1}{2}} \quad (102)$$

The coupling coefficients defined by the above equations for FIGS. 1, 2 and 4–6 produce an optimum configuration with regard to loss in the antenna feed network. That is, when the outputs of each subarray have the same phase and when the subarray inputs have the same phase and amplitude, then no power is absorbed in the resistor loads in the Wilkenson dividers. In some instances, a phase reversal of some elements is required for certain illumination functions; in these cases, the coupling coefficients define a minimum power loss condition.

An antenna feed network has been described for distributing a plurality of microwave signals to a plurality of spaced apart overlapping subarrays having common antenna elements comprising a first plurality of power dividers, each having an input and at least two outputs interconnected in series from each respective output to provide a plurality of first output terminals from a first input terminal, the first input terminal adapted for coupling to one of the microwave signals, a second plurality of power dividers each having an input and at least two output terminals interconnected in series from each respective output to provide a plurality of second output terminals from a second input terminal, the second input terminal adapted for coupling to another one of the microwave signals, a plurality of power combiners each having a first and second input coupled to one of the plurality of first and second output terminals, respectively, and having an output terminal adapted for coupling to one of the antenna elements respectively, the first plurality of power dividers spaced apart to provide a predetermined electrical path length from the first input terminal to each output terminal of the first plurality of dividers, and the second plurality of power dividers spaced apart to provide a predetermined electrical path length from the second input terminal to each output terminal of the second plurality of power dividers.

The invention claimed is:

1. An antenna feed network for distributing a plurality of microwave signals to a plurality of spaced apart overlapping subarrays having common antenna elements comprising:

a first plurality of power dividers each having an input and at least two outputs interconnected in series from each respective output to provide a plurality of first output terminals from a first input terminal, said first input terminal adapted for coupling to one of said microwave signals, a second plurality of power dividers, each having an input and at least two outputs interconnected in series from each respective output to provide a plurality of second output terminals from a second input terminal, said second input terminal adapted for coupling to another one of said microwave signals, a plurality of power combiners each having a first and second input coupled to one of said first and second output terminals, respectively, and having an output terminal adapted for coupling to one of said antenna elements, respectively, said plurality of power combiners including at least one power combiner of the Wilkenson type, said first plurality of power dividers spaced apart to provide a predetermined electrical path length from said first input terminal to each output terminal of said first plurality of power dividers, and said second plurality of power dividers spaced apart to provide a predetermined electrical path length from said second input terminal to each output terminal of said second plurality of power dividers.

2. The antenna feed network of claim 1 wherein said first plurality of power dividers includes a microstrip power divider of the Wilkenson type.

3. The antenna feed network of claim 1 wherein said first plurality of power dividers includes a strip-line power divider of the Wilkenson type.

4. The antenna feed network of claim 1 wherein said first plurality of power dividers and the second plurality of power dividers are interconnected on the upper surface of a printed circuit board and include a zero db branch arm hybrid to provide a crossover with a single layer of metallization on the upper surface of the printed circuit board.

5. The antenna feed network of claim 4 wherein said printed circuit board includes a ground plane on the lower surface to form a microstrip transmission line between the conductors on the upper surface and the ground plane on the lower surface of the printed circuit board.

6. The antenna feed network of claim 4 wherein said first plurality of power combiners are interconnected on a single layer of metallization on said upper surface of said printed circuit board, and includes at least one zero db branch line hybrid coupler to provide a crossover on said single layer of metallization.

7. The antenna feed network of claim 1, wherein said plurality of first output terminals is eight.

8. The antenna feed network of claim 7 wherein said plurality of second output terminals is eight.

9. The antenna feed network of claim 7 wherein said plurality of power combiners is four.

10. The antenna feed network of claim 1 wherein said plurality of first output terminals is four and said plurality of power combiners is two.

11. The antenna feed network of claim 1 wherein said predetermined electrical path length from said first input terminal to each output terminal of said first plurality of power dividers is substantially equal.

12. The antenna feed network of claim 11 wherein said predetermined electrical path length from said second input terminal to each output terminal of said second plurality of power dividers is substantially equal.

13. The antenna feed network of claim 4 wherein said printed circuit board includes a first ground plane on the lower surface and a layer of dielectric material over said upper surface and over said first and second plurality of power dividers, said layer of dielectric material having a second ground plane thereover to form a strip transmission line between the conductors on said upper surface and said first and second ground planes.

14. An antenna feed network for distributing a plurality of microwave signals to a plurality of spaced apart overlapping subarrays having common antenna elements comprising:

a first plurality of power dividers each having an input and at least two outputs interconnected in series from each respective output to provide a plurality of first output terminals from a first input terminal, said first input terminal adapted for coupling to one of said microwave signals, a second plurality of power dividers, each having an input and at least two outputs interconnected in series from each respective output to provide a plurality of second output terminals from a second input terminal, said second input terminal adapted for coupling to another one of said microwave signals, a first plurality of power combiners each having at least a first and second input, and an output, said first plurality of power combiners interconnected in series from each respective output to a respective input to provide a first combiner network having a plurality of third input terminals and a third output terminal, a first one of said third input terminals coupled to one of said first output terminals, a second one of said third input terminals coupled to one of said second output terminals, said other third input terminals coupled to selected ones of said plurality of microwave signals, said third output terminal adapted for coupling to one of said antenna elements, said first plurality of power dividers spaced apart to provide a predetermined electrical path length from said first input terminal to each output terminal of said first plurality of power dividers, and said second plurality of power dividers spaced apart to provide a predetermined electrical path length from said second input terminal to each output terminal of said second plurality of power dividers.

15. The antenna feed network of claim 14 wherein said first plurality of power dividers includes a microstrip power divider of the Wilkenson type.

16. The antenna feed network of claim 14 wherein said first plurality of power dividers includes a strip-line power divider of the Wilkenson type.

17. The antenna feed network of claim 14 wherein said first plurality of power dividers and the second plurality of power dividers are interconnected on the upper surface of a printed circuit board and inlude a zero db branch arm hybrid to provide a crossover with a single layer of metallization on the upper surface of the printed circuit board.

18. The antenna feed network of claim 17 wherein said printed circuit board includes a ground plane on the lower surface to form a microstrip transmission line between the conductors on the upper surface and the ground plane on the lower surface of the printed circuit board.

19. The antenna feed network of claim 17 wherein said first plurality of power combiners are interconnected on a single layer of metallization on said upper surface of said printed circuit board, and includes at least one zero db branch line hybrid coupler to provide a crossover on said single layer of metallization.

20. The antenna feed network of claim 14 wherein said plurality of first output terminals is twelve.

21. The antenna feed network of claim 14 wherein said plurality of first output terminals is sixteen.

22. The antenna feed network of claim 14 wherein said first plurality of power combiners is two coupled in series.

23. The antenna feed network of claim 14 wherein said first plurality of power combiners is three with the output of two coupled to respective inputs of the third.

24. The antenna feed network of claim 14 further including a second plurality of power combiners each having at least a first and second input and an output, said second plurality of power combiners interconnected in series from each respective output to a respective input to provide a second combiner network having a plurality of fourth input terminals and a fourth output terminal, a first one of said fourth input terminals coupled to one of said first output terminals, a second one of said fourth input terminals coupled to one of said second output terminals, said other fourth input terminals coupled to selected ones of said plurality of microwave signals, said fourth output terminal adapted for coupling to one of said antenna elements.

25. The antenna feed network of claim 14 wherein said first plurality of power combiners are spaced apart to provide a substantially equal electrical path length from said third input terminals to said third output terminal.

26. The antenna feed network of claim 24 wherein said second plurality of power combiners are spaced apart to provide a substantially equal electrical path length from said fourth input terminals to said fourth output terminal.

27. The antenna feed network of claim 14 wherein said predetermined electrical path length from said first input terminal to each output terminal of said first plurality of power dividers is substantially equal.

28. The antenna feed network of claim 27 wherein said predetermined electrical path length from said second input terminal to each output terminal of said second plurality of power dividers is substantially equal.

29. The antenna feed network of claim 17 wherein said printed circuit board includes a first ground plane on the lower surface and a layer of dielectric material over said upper surface and over said first and second plurality of power dividers, said layer of dielectric material having a second ground plane thereover to form a strip transmission line between the conductors on said upper surface and said first and second ground planes.

30. An antenna feed network for distributing a plurality of microwave signals to a plurality of spaced apart overlapping subarrays having common antenna elements comprising:

a first plurality of power dividers each having an input and at least two outputs interconnected in series from each respective output to provide a plurality of first output terminals from a first input terminal, said first input terminal adapted for coupling to one of said microwave signals, a second plurality of power dividers, each having an input and at least two outputs interconnected in series from each respective output to provide a plurality of second output terminals from a second input terminal, said second input terminal adapted for coupling to another one of said microwave signals, a first plurality of power combiners each having at least first and second inputs and an output terminal, said first input of each of said first plurality of power combiners coupled to said first output terminals, respectively, said second input of each of said first plurality of power combiners coupled to selected ones of said plurality of microwave signals, said output terminals of said first plurality of power combiners adapted for coupling to said antenna elements, respectively, said first plurality of power dividers spaced apart to provide a predetermined electrical path length from said first input terminal to each output terminal of said first plurality of power dividers, and said second plurality of power dividers spaced apart to provide a predetermined electrical path length from said second input terminal to each output terminal of said second plurality of power dividers.

31. The antenna feed network of claim 30 further including a second plurality of power combiners each having at least first and second inputs and an output terminal, said first input of each of said second plurality of power combiners coupled to said output terminals of said first plurality of power combiners, respectively, said second input of each of said second plurality of power combiners coupled to one or more of said plurality of microwave signals, said output terminals of said second plurality of power combiners adapted for coupling to said antenna elements, respectively.

32. The antenna feed network of claim 30 wherein said predetermined electrical path length from said first input terminal to each output terminal of said first plurality of power dividers is substantially equal.

33. The antenna feed network of claim 32 wherein said predetermined electrical path length from said second input terminal to each output terminal of said second plurality of power dividers is substantially equal.

* * * * *

UNITED STATES PATENT AND TRADEMARK OFFICE

CERTIFICATE OF CORRECTION

PATENT NO. : 4,652,880

DATED : Mar. 24, 1987

INVENTOR(S) : Alvin W. Moeller, Robert E. Willey, Allen I. Sinsky

It is certified that error appears in the above-identified patent and that said Letters Patent is hereby corrected as shown below:

In the Specification

Column 14, line 50, equation 12, change "178" to --1/2--.

Column 16, line 35, equation 59, delete "$V_3$+", second occurrence; same line, move "(59)" toward the right margin.

Claim 1 should read as follows:

1. An antenna feed network for distributing a [plurality of] microwave signal[s] to a plurality of spaced apart overlapping subarrays having common antenna elements comprising:

a first plurality of power dividers each having an input and at least two outputs interconnected in series from each respective output to provide a plurality of first output terminals from a first input terminal, said first input terminal [adapted for coupling] coupled through a first phase shifter to [one of] said microwave signal[s]

a second plurality of power dividers, each having an input and at least two outputs interconnected in series from each respective output to provide a plurality of second output terminals from a second input terminal, said second input terminal [adapted for coupling] coupled through a second phase shifter to [another one of] said microwave signal[s], a plurality of power combiners each having a first and second input coupled to one of said first and second output terminals, respectively, and having an output terminal adapted for coupling to one of said antenna elements, respectively, said plurality of power combiners including at least one power combiner of the Wilkenson type,

UNITED STATES PATENT AND TRADEMARK OFFICE

CERTIFICATE OF CORRECTION

PATENT NO. : 4,652,880

DATED : Mar. 24, 1987

INVENTOR(S) : Alvin W. Moeller, Robert E. Willey, Allen I. Sinsky

It is certified that error appears in the above-identified patent and that said Letters Patent is hereby corrected as shown below:

said first plurality of power dividers spaced apart to provide a predetermined electrical path length from said first input terminal to each output terminal of said first plurality of power dividers, and said second plurality of power dividers spaced apart to provide a predetermined electrical path length from said second input terminal to each output terminal of said second plurality of power dividers.

Signed and Sealed this

Fifteenth Day of December, 1987

*Attest:*

DONALD J. QUIGG

*Attesting Officer*

*Commissioner of Patents and Trademarks*